United States Patent [19]

Aizawa

[11] 4,303,995

[45] Dec. 1, 1981

[54] ELECTRONIC TIMEPIECE WITH CALENDAR DISPLAY ARRANGEMENT

[75] Inventor: Hitomi Aizawa, Suwa, Japan

[73] Assignee: Kabushiki Kaisha Suwa Seikosha, Tokyo, Japan

[21] Appl. No.: 974,401

[22] Filed: Dec. 29, 1978

[30] Foreign Application Priority Data

Dec. 29, 1977 [JP] Japan ..... 52/159317

[51] Int. Cl.[3] ..... G04B 19/24

[52] U.S. Cl. ..... 368/28; 368/29; 368/30; 368/71; 368/72

[58] Field of Search ..... 58/23 R, 4 R, 4 A, 58, 58/85.5, 16 R, 16 D, 57.5, 152 B, 152 R; 368/28-30, 71, 72, 64, 82, 83, 84, 239, 240, 241, 250, 251

[56] References Cited

U.S. PATENT DOCUMENTS

| | | | |
|---|---|---|---|
| 4,005,571 | 2/1977 | Wolff | 58/152 B X |
| 4,099,372 | 7/1978 | Beyers, Jr. | 58/152 R X |
| 4,104,865 | 8/1978 | Sasaki | 58/57.5 X |
| 4,117,657 | 10/1978 | Shimizu | 58/58 X |

*Primary Examiner*—Ulysses Weldon

*Attorney, Agent, or Firm*—Blum, Kaplan, Freidman, Silberman & Beran

[57] ABSTRACT

An electronic wristwatch having a calendar display arrangement that is capable of memorizing and displaying date information is provided. Specifically, a digital display that is capable of displaying calendar information is coupled to a calendar display memory that is capable of selectively storing a plurality of predetermined dates therein. Operative means are coupled to the memory and the calendar display for effecting a display of the plurality of dates stored in the memory by the calendar display.

14 Claims, 9 Drawing Figures

ELECTRONIC TIMEPIECE WITH CALENDAR DISPLAY ARRANGEMENT

BACKGROUND OF THE INVENTION

This invention is directed to an electronic wristwatch having a calendar display arrangement, and in particular to an electronic wristwatch having a calendar display arrangement for memorizing and displaying a plurality of predetermined dates therein.

Heretofore, electronic wristwatches capable of highly accurate timekeeping have gained widespread popularity. In particular, digital display wristwatches utilizing a liquid crystal display digits for providing a digital display of timekeeping information, calendar information and the like have contributed to this popularity. Moreover, these digital display electronic wristwatches have been equipped with timers and alarms in order to provide signals to the wearer of the wristwatch that a particular amount of time has elapsed, or alternatively, that a particular time has arrived.

The instant invention is directed to applying this type of concept to periods of time that extend over weeks and months instead of minutes and hours as are often measured in electronic wristwatches having chronographic displays and/or alarm devices. It is noted that in daily life, people often utilize diaries, appointment books and the like to arrange a schedule for a month or a period of several months. Such information as office holidays, school holidays, birthdays, etc. are entered into the diary or calendar in order to facilitate one's planning. To this end, the instant invention is characterized by the use of a calendar display arrangement in an electronic wristwatch that permits a plurality of dates over a period of several weeks or several months to be stored in a memory, and conveniently displayed by a digital calendar display.

ASSEMBLY OF THE INVENTION

Generally speaking, in accordance with the instant invention, a digital display electronic wristwatch having a calendar display arrangement is provided. The wristwatch includes an electronic timekeeping circuit for producing low frequency timekeeping signals and a plurality of series connected timekeeping counters for producing timekeeping signals representative of time and date information. A first digital display is provided for displaying time information in response to timekeeping signals representative of time being applied thereto. A second display is provided to display calendar information in response to timekeeping signals representative of calendar information being applied thereto. The invention is particularly characterized by a calendar display memory coupled to the second display, the memory being adapted to store a plurality of predetermined dates therein. An operative circuit is selectively coupled to the memory and the second display for effecting a display by the second display of the plurality of dates stored in the memory.

In an exemplary embodiment of the instant invention, a plurality of dates spanning several weeks or several months can be selectively written into the memory. Additionally, all of the dates selectively stored in the memory can be simultaneously cleared and a display can be provided for indicating the occurrence of this function. Accordingly, it is an object of the instant invention to provide an improved calendar display arrangement for an electronic wristwatch.

Still another object of the instant invention is to provide a calendar display arrangement for an electronic wristwatch that is capable of memorizing a plurality of dates spanning several weeks or several months, and being capable of selectively providing a display of each of the dates stored therein.

Still a further object of the instant invention is to provide a calendar display arrangement in a digital display electronic wristwatch wherein a plurality of dates spanning at least several weeks can be written into the display arrangement and semi-permanently stored therein.

Still another object of the instant invention is to provide a display arrangement for an electronic digital display wristwatch wherein a plurality of predetermined dates spanning at least several weeks can be stored in a memory and each of the dates can be simultaneously cleared therefrom.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which.

DETAILED DESCRIPTION OF THE PREFERRED EMBODIMENTS

Figure 1A:
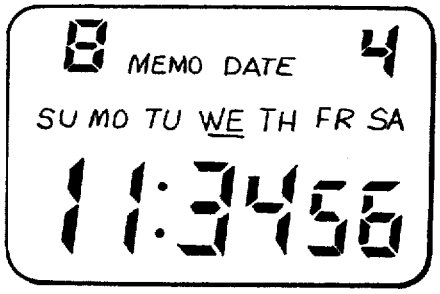
FIG. 1*a* is a plan view of a digital display for an electronic wristwatch constructed in accordance with the preferred embodiment of the instant invention, disposed in a normal display mode.
Figure 1B:
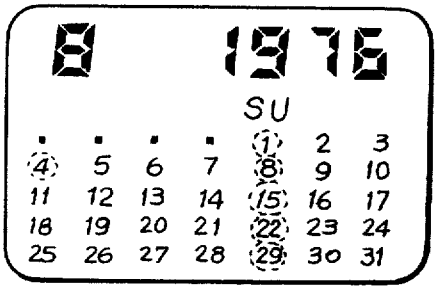
FIG. 1*b* is a plan view of a digital display for an electronic timepiece constructed in accordance with a preferred embodiment of the instant invention, disposed in a calendar display mode.
Figure 2:
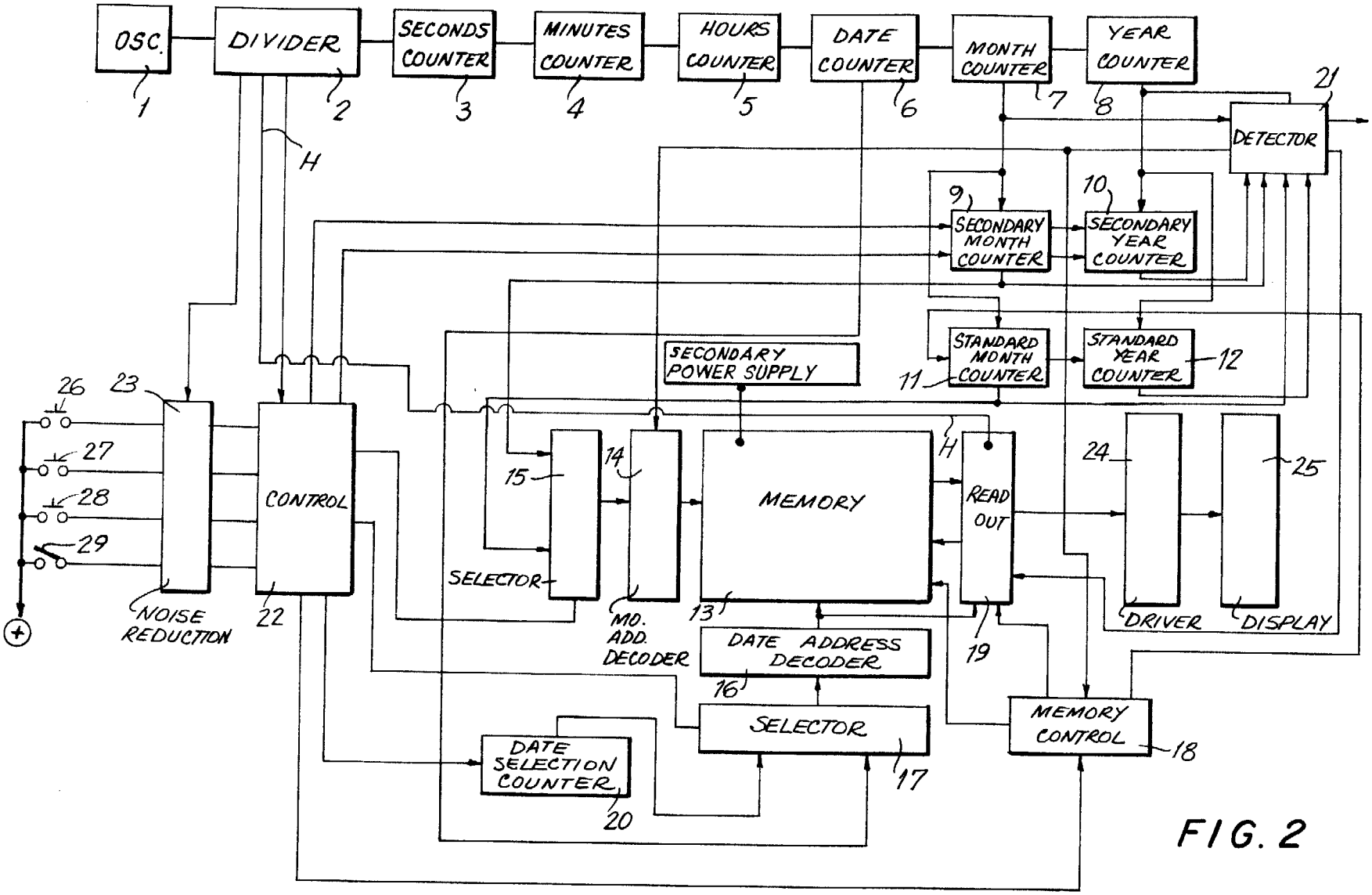
FIG. 2 is a block circuit diagram of an electronic wristwatch having a calendar display arrangement according to the instant invention.

Reference is now made to FIGS. 1*a*, 1*b* and FIG. 2, wherein an electronic digital display wristwatch having a calendar display arrangement constructed in accordance with a preferred embodiment of the instant invention is depicted. Specifically, the timekeeping circuit is comprised of an oscillator circuit 1 and divider circuit 2. The oscillator circuit 1 is a conventional C-MOS oscillator circuit having a quartz crystal vibrator capable of vibrating at a frequency on the order of $2^{16}$ Hz, so that the oscillator circuit produces a high frequency time standard signal having a frequency corresponding to the vibrational frequency of the vibrator. Divider circuit 2 is comprised of a plurality of series-connected binary divider stages for dividing down the high frequency time standard signal and producing a low frequency timing signal having a frequency on the order of one Hz. The low frequency timing signal is applied to a second counter 3, which is in turn coupled to a plurality of series connected counters including minutes counter 4, hours counter 5, date counter 6, month counter 7, and year counter 8. Each of the timekeeping counters 3 through 8 are respectively adapted to apply seconds timekeeping signals, minutes timekeeping signals, hours timekeeping signals, date timekeeping signals, month timekeeping signals and year timekeeping signals to a digital display in order to effect a digital display of this information in a conventional manner when the digital display is disposed in a normal timekeeping display mode.

As is illustraated in FIG. 1*a*, the timekeeping signals produced by the seconds counter 3, minutes counter 4 and hours counter 5 are applied to a digital display to produce a display of actual time (11:34:56) when the timepiece is disposed in a normal timekeeping display mode. Additionally, August and the fourth day of the month are displayed by applying the timekeeping signals produced by the date counter 6 and month counter 7 to the digital display. Moreover, as illustrated in FIG. 1*b*, when the digital display is disposed into a calendar display mode, the date and year are displayed together with a calendar display. Digital displays capable of producing a display of the type illustrated in FIG. 1*a* and being disposed into a cleandar display made in the manner illustrated in FIG. 1*b* are known in the art and an example of one type of multilayer liquid crystal display of this type is described in detail in copending U.S. application Ser. No. 943,589, assigned to the same assignee of the instant invention. As illustrated in FIG. 1*b*, the numbers having dashed circles therearound, to wit, day numbers 1, 4, 8, 15, 22 and 29 of the month of August, 1956, are flickered at a duty ratio of $\frac{7}{8}$ths of the one-second period that the remaining digits are driven.

Referring again to FIG. 2, the first, fourth, eighth, fifteenth, twenty-second and twenty-ninth days of the month of August are selectively flickered by writing a binary "1" into the appropriate addresses in the memory 13, in a manner to be discussed in greater detail below. By providing this information in the memory 13, however, in addition to displaying an entire monthly calendar by disposing the timepiece into a calendar display mode, the specific dates that have been written into the memory can also be distinguished and hence provide a reminder to the wearer of the wristwatch of specific dates and schedules that have been planned.

Figure 3:
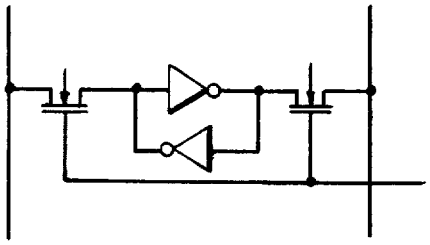
FIG. 3 is a circuit diagram of a single bit of a memory circuit of the type utilized in the calendar display wristwatch illustrated in FIG. 2.

As aforenoted, the memory 13 is adapted to memorize predetermined or selected dates by utilizing a plurality of RAM storage bits of the type illustrated in FIG. 3. In an exemplary embodiment of the instant invention, the memory 13 is provided with 12×31 bits and is capable of storing the dates for an entire year. In order to write-in the dates into the memory 13, a manually operated switching arrangement including lock switch 29, mode switch 28, select switch 27 and set switch 26 are coupled through a noise reduction circuit 23, control circuit 22, selector circuit 15, month address decoder 14, date selection counter 20, selector circuit 17 and date address decoder 16, to the memory 13, in order to selectively write-in the dates for any number of weeks or months in the year that the wearer of the wristwatch wishes to recall at any particular time.

Specifically, when it is desired to write-in a date into the memory 13, mode select switch 28 is actuated to dispose the wristwatch in a calendar display mode, whereafter lock switch 29 is turned on. Thereafter, the specific addresses in the memory 13 are cyclically selected by select switch 27 aand once selected, a binary "1" or "0" is written into the addresses of the memory 13. A readout circuit 19, illustrated in detail in FIG. 4, is coupled to the output of memory 13 for reading out the specific addresses written into and stored in the memory 13 and applying this information through a driver circuit 24 to the calendar display 25.

Figure 4:
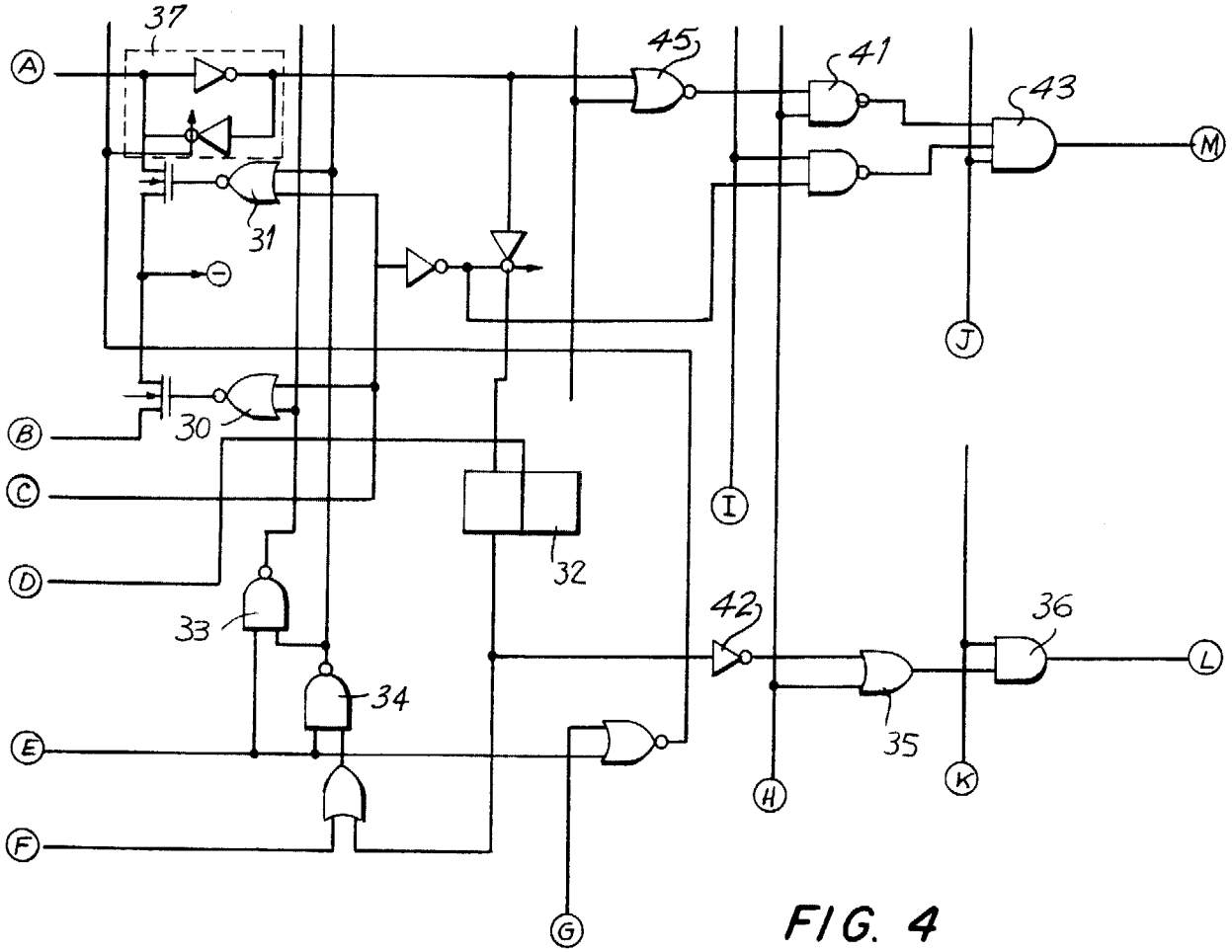
FIG. 4 is a circuit diagram illustrating the read-out circuit of the digital display electronic wristwatch depicted in FIG. 2.

Referring specifically to FIG. 4, NOR gate 30 or NOR gate 31 is selected in order to respectively set or reset each address of the memory. At the time that data is written into the memory, NOR gate 30 or NOR gate 31 is selected, and in response thereto, either a binary "1" or binary "0" is written into the memory. Moreover, at the time that the data is read out of the memory, the data in the memory circuit is written into latch circuit 37, applying an enabling signal through NOR gate 45 to enable NAND gate 41 and permit a flicker signal H to be inverted by NAND gate 41 and applied through AND gate 43 as an output M to the date display, to effect a flickering of the dates in the manner discussed above with respect to FIG. 1*b*. By way of enablement, the read-out circuit 19 is illustrated in detail. However, only those elements with reference numerals described herein are necessary to achieve the functions and operations described and claimed herein.

When the data stored in the memory is a binary "1", and same is read out of the memory, the binary "1" data is also applied through latch flip-flop circuit 32, to inverter 42 and is therefore applied as a binary "0" to a first input of OR gate 35. At this time, the output of OR gate 35 will be the flicker signal H, which signal is applied to a first input of AND gate 36 to produce the flicker signal L.

It is noted that in addition to the months timekeeping counter 7 and year timekeeping counter 8 for producing timekeeping signals representative of the month and year, a secondary month counter 9 and secondary year counter 10 for effecting a calendar display is provided. When the contents or count of the month counter 7 is coincident with the contents or count of the secondary month counter 9, and similarly, the contents of the year timekeeping counter 8 and the secondary year timekeeping counter 10 correspond to each other, a present month signal K having a binary "1" state is applied to the readout circuit by the coincidence detector circuit 21. Referring again to FIG. 4, if the signal K is a binary "1" the flicker signal H is applied as the output L of AND gate 36. Specifically, because the contents of the month counter 7 and those of the secondary month counter 9 as well as the contents of the timekeeping counter 8 and the secondary year counter 10 correspond to each other, a flicker signal is applied to the digital display indicating that the month information stored in the memory is presently being displayed. Plus, if the addresses of the present month are stored in the memory 13, it can readily be determined whether the present month and date have been written into it or not.

A specific example of the foregoing is depicted in FIG. 1*a*. For example, if it is actually Aug. 4, 1976, as displayed in FIG. 1*a*, the liquid crystal display segments forming the word "MEMO" are flickered in response to the signal H being applied thereto, when the address in the memory 13 corresponding to Aug. 4, 1976 has a binary "1" stored therein. Thus, by utilizing this feature, the instant invention permits the wearer of the wristwatch to actually determine when a day occurs that has been previously written into the memory, while the timepiece is disposed in a normal display mode.

The coincident detection function detailed above will be particularly helpful to the wearer of the wristwatch when an appointment is made in advance. For example, if the wearer of the wristwatch has made an appointment to meet someone on Sept. 5, 1976, he will write into the Sept. 5, 1976 address of the memory a binary "1". Thereafter, on Sept. 5, 1976, the liquid crystal display segments defining the word "MEMO" will be flickered to thereby remind the wearer of the wristwatch of the appointment. Thus, by flickering the liquid crystal display segments defining the word "MEMO", an alarm function is provided. It is noted, however, that a buzzer can also be provided in the electronic wristwatch in order to provide an audio signal when the coincidence detection circuit detects a coincident condition of the type detailed above. Moreover, when the electronic wristwatch is disposed into a calendar display mode, the entire month of September, 1976 can be displayed, and at the same time, each of the dates that have been entered into the memory 13, and in particular, Sept. 5, 1976 are flickered to provide an indication to the wearer of the dates that have been entered for the month of September 1976. Thus by providing a memory capable of storing specific dates over many weeks or many months, a more functional and convenient electronic wristwatch is provided.

Notwithstanding the numerous advantages provided by a wristwatch having a calendar display arrangement of the type to which the instant invention is directed, one problem that is likely to be encountered is the reading in of numerous addresses over a period of a year. Often the wearer of the wristwatch will prefer to clear the entire memory. If the same circuitry utilized to write-in the binary "1" signals to the addresses is utilized to write into each previously selected address a binary "0", when the selected dates are to be cleared each of the addresses must be selected one-by-one, and hence take the wearer a considerable amount of time to clear each of the addresses.

For this reason, the instant invention further contemplates the use of a clearing circuit for simultaneously clearing all of the contents of the memory 13. It is noted, however, that in order to avoid the possibility that the memory can be inadvertently cleared by this clearing circuit, the instant invention requires a specific operation of the operative switches in order to actuate the clearing circuit and thereby effect a writing in of a binary "0" into each of the addresses of the memory.

First, the pushbutton 28 is actuated, to thereby dispose the wristwatch into a calendar display mode. Once the electronic wristwatch is in a calendar display mode, both set switch 26 and select switch 27 are actuated, and finally, lock switch 29 is turned ON. In response thereto, control circuit 22 supplies a memory reset signal to the memory control circuit 18, which circuit in turn applies a suitably timed clear signal F to the memory 13. As illustrated in FIG. 4, if the clear signal F is a binary "1" signal, and it is supplied in synchronism with command signal E, a binary "0" is written into the memory circuit through the NOR gate 31. The same operation is applied to each of the $12\times31$ bits of the memory 13, thereby clearing each and every address thereof.

Figure 6:
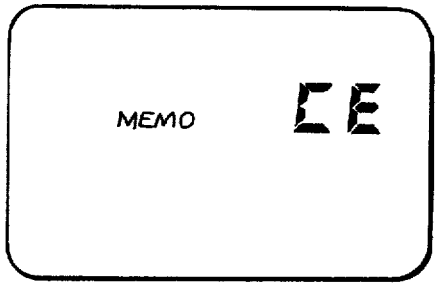
FIG. 6 is a plan view of a digital display for an electronic wristwatch constructed in accordance with the instant invention, disposed in a clear mode.
Figure 5A:
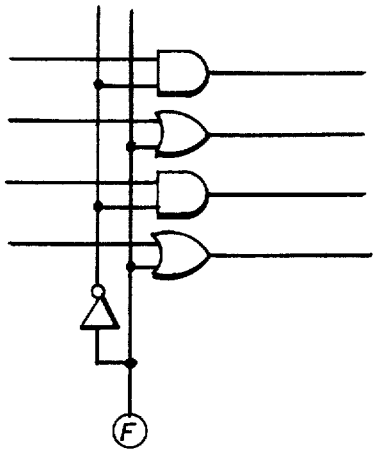
FIG. 5*a* is a circuit diagram of a memory clear circuit constructed in accordance with the preferred embodiment of the instant invention.
Figure 5B:
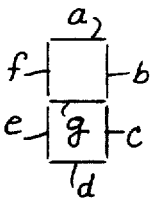
FIG. 5*b* is an illustration of a seven-segmented display electrode pattern for use in the digital display of the electronic wristwatch depicted in FIG. 6.

Reference is now made to FIG. 5*a* and 5*b*, wherein a circuit for effecting a display indication of the clearing function detailed above is depicted. Specifically, by applying a clear signal F through an OR gate to each segment to be rendered visually distinguishable when a clear function is being performed, and further to an AND gate when each segment of a conventional seven-segment display digit when the segment is not to be rendered visually distinguishable, a visual indication of the clearing function can be provided. Specifically, the seven-segment display digit illustrated in FIG. 5*b* includes segment electrodes a through g respectively. When the segment electrodes, a, f, e and d are rendered visually distinguishable and the remaining electrodes are not rendered visually distinguishable, the letter C is displayed. Similarly, when the segment electrodes, a, f, e, g and d are each rendered visually distinguishable, and the remaining segments are not rendered visually distinguishable, the letter E is visually indicated by the digital display. Accordingly, by providing circuits of the type illustrated in FIG. 5*a* when the clear signal F is applied through display clear circuits of the type illustrated in FIG. 5*a*, the display segments defining the word "MEMO" and the letters "CE" are rendered visually distinguishable, in the manner illustrated in FIG. 6 providing an indication to the wearer of the wristwatch that the entire memory was cleared. The digital display digits are thereby utilized to form words to further facilitate the display indication to the wearer that the memory is being cleared.

It is noted that for the electronic wristwatch discussed in detail above, address data for about one year can be entered into the memory. Nevertheless, if, during the year, the battery for the electronic wristwatch must be replaced, the information stored in the memory will be lost, and therefore must be rewritten into the memory once the battery is changed. In order to eliminate this disadvantage, the instant invention contemplates the use of a secondary voltage supply for applying a sufficient voltage to energize the memory during replacement of the main power supply. In a preferred embodiment, either a secondary battery or alternatively, a capacitor capable of storing a sufficient charge to energize the electronic wristwatch for a sufficient period to permit replacement of the battery can be utilized. In either case, a circuit would be provided for detecting when the battery is removed or the supply voltage produced by the main battery falls below a predetermined level, and in response thereto would couple the secondary voltage supply to the memory. For example, if a capacitor is to be utilized, wherein the capacitance thereof is 0.22 $\mu$f and the leakage current of the memory circuit is 0.01 $\mu$A, the following time constant is obtained:

$$0.22\times10^{-6}\times300\times10^{6}=66$$

when the voltage supplied is equal to 3 V. Thus, when this type of capacitor is utilized, the memory can be energized for about one minute, and hence, if the main battery can be replaced within one minute, the above-noted disadvantage of losing the contents of the memory when the main power supply is replaced is avoided.

Figure 7:
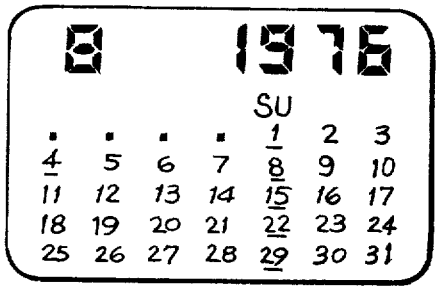
FIG. 7 is a plan view of a further calendar display arrangement for an electronic wristwatch constructed in accordance with the instant invention, disposed in a calendar display mode.

Referring now to FIG. 7, a further digital display arrangement for illustrating the dates stored in the memory is depicted. In lieu of the flickering of the dates read into the memory in the manner illustrated in FIG. 1*b*, a segment electrode can be provided under each display digit to thereby light a line under each date read into the memory. In certain circumstances, this type of display arrangement may be preferred over the display arrangement illustrated in FIG. 1*b* for providing to the wearer a display indication of the date stored in the memory.

Accordingly, the instant invention is particularly characterized by an improved display arrangement, which permits appointments or important dates spanning several weeks or several months to be stored in a memory, in order to permit the timepiece to provide an indication when that date occurs, and further provide the wearer with an indication of which dates have been stored in the memory.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said to fall therebetween.

What is claimed is:

1. In an electronic timepiece including timekeeping circuit means for producing a low frequency timing signal, a plurality of series connected timekeeping counters for producing timekeeping signals representative of time information and calendar information in response to said low frequency timing signal being applied thereto, first display means for displaying at least one of time information and calendar information in response to said timekeeping signals representative of time being applied thereto and second display means for displaying calendar information representative of a multiplicity of dates for a predetermined interval of time the improvement comprising a calendar display memory means coupled to at least said second display means, said calendar display memory means being adapted to store a plurality of predetermined calendar information dates therein and operative means selectively coupled to said memory means and said second display means for simultaneously rendering visually distinguishable certain of said dates in said second display means, said visually distinguishable dates being representative of the calendar information dates stored in said memory means.

2. An electronic timepiece as claimed in claim 1, wherein said operative means includes address decoder providing an indication in response to said coincidence signal being applied thereto.

3. An electronic timepiece as claimed in claim 2, wherein said operative means includes manually operated switch means coupled to said address decoder means for selectively controlling said address decoder means to permit said dates written into said memory means to be displayed by said second display means in response to the manual operation of said manually operated means.

4. An electronic timepiece as claimed in claim 1, wherein said second display means includes a calendar display having a plurality of visual indication means for effecting a calendar display of a plurality of dates, said second display means including visually distinguishable means for distinguishing each of the visual indication means displaying dates stored in said memory means from the remaining visual indication means of said second display means.

5. An electronic timepiece as claimed in claim 4, wherein said divider means adapted to produce an intermediate frequency flicker signal, and a read-out circuit means intermediate said memory means and said second display means, said read-out means including said visually distinguishable means for detecting each of the dates stored in said memory means and in response thereto applying to each of said visual indication means in said second display means representative of said dates, said intermediate frequency flicker signal to thereby flicker said visual indication means.

6. An electronic timepiece as claimed in claim 4, wherein said visually distinguishable means includes a segment electrode proximate to each visual indication means, said segment electrode corresponding to the date stored in said memory means being adapted to be rendered visually distinguishable when said second display means effects a display of said plurality of dates stored in said memory means.

7. An electronic timepiece as claimed in claim 1, and including secondary counter means operatively coupled to said calendar display memory means for storing a predetermined count representative of a calendar information date stored in said memory means, and detection means for detecting coincidence between the count of said secondary counter means and the count of said timekeeping signals produced by certain of said series connected timekeeping counters producing timekeeping signals representative of calendar information, said detection means being adapted to produce a command signal in response to detecting said coincidence, and indication means for means for selectively storing in said memory means predetermined calendar information dates.

8. An electronic timepiece as claimed in claim 7, wherein said indication means adapted to produce an alarm signal in response to said coincident signal being applied thereto.

9. An electronic wristwatch as claimed in claim 7, wherein said indication means is a visually distinguishable means included in said first digital display means for visually indicating when said coincident signal is applied thereto, to thereby visually indicate that the date displayed by said wristwatch is the same as one of said dates stored in said memory means.

10. An electronic timepiece as claimed in claim 9, wherein said visually distinguishable means includes a plurality of liquid crystal display segments adapted to be flickered when said coincidence signal is applied thereto.

11. An electronic timepiece as claimed in claim 1, and including clearing circuit coupled to said operative means for producing a clear signal in response to the actuation of said operative means, said memory means being coupled to said clearing circuit and adapted to have each of the dates stored therein simultaneously cleared in response to said clear signal being applied thereto.

12. An electronic timepiece as claimed in claim 11, when one of said first and second display means includes at least one seven-segmented liquid crystal display digit, said clearing circuit being coupled to said seven-segmented liquid crystal display digit for selectively lighting several of said segments to thereby define a lit pattern representative of the clearing of said memory means.

13. An electronic timepiece as claimed in claim 12, further including first logic gates coupled intermediate said clearing circuit and said segments to be energized in response to said clear signal and further logic gates coupled intermediate said clearing circuit and said remaining segments for preventing said remaining segments from being energized in response to said clear signal.

14. An electronic timepiece as claimed in claim 1, and including a primary power source for normally energizing said memory means to thereby maintain said dates stored therein, and a secondary power supply for energizing said memory means for a predetermined interval of time sufficient to permit said first voltage supply to be replaced, and thereby retain said dates stored in said memory during replacement of said primary power supply.

* * * * *